US010551113B1

(12) United States Patent
Wantland et al.

(10) Patent No.: US 10,551,113 B1
(45) Date of Patent: Feb. 4, 2020

(54) APPLIANCE EQUIPPED WITH A CASCADING BASKET SYSTEM

(71) Applicant: Haier US Appliance Solutions, Inc., Wilmington, DE (US)

(72) Inventors: Louis A. Wantland, Louisville, KY (US); Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/251,201

(22) Filed: Jan. 18, 2019

(51) Int. Cl.
*F25D 25/00* (2006.01)
*F25D 25/02* (2006.01)
(Continued)

(52) U.S. Cl.
CPC ..... *F25D 25/022* (2013.01); *A47B 88/49* (2017.01); *A47B 88/75* (2017.01); *F25D 23/02* (2013.01); *F25D 25/025* (2013.01)

(58) Field of Classification Search
CPC ..... F25D 25/025; F25D 25/022; F25D 25/04; F25D 25/00; F25D 25/02; F25D 23/021; F25D 29/005; F25D 23/087; F25D 23/00; F25D 23/02; F25D 23/028; F25D 23/04; F25D 23/025; F25D 23/022; F25D 23/067; F25D 11/02; A47B 2210/17; A47B 2210/175; A47B 2210/0045; A47B 2210/004; A47B 88/437; A47B 88/75; A47B 88/78; A47B 88/423; A47B 88/90; A47B 88/46; A47B 51/00; A47B 21/02; A47B 2220/0013; A47B 2021/066; A47B 96/16; A47B 67/04
(Continued)

(56) References Cited

U.S. PATENT DOCUMENTS 2,267,043 A * 12/1941 Premo ..... A47B 88/493 384/18
4,912,727 A * 3/1990 Schubert ..... F16C 29/00 248/206.5
(Continued)

FOREIGN PATENT DOCUMENTS

DE 19858387 * 6/2000
JP 2008000156 * 1/2008
(Continued)

*Primary Examiner* — Janet M Wilkens
(74) *Attorney, Agent, or Firm* — Dority & Manning, P.A.

(57) ABSTRACT

An appliance equipped with a cascading basket system is provided. In one example aspect, the cascading basket system includes a first basket connected to a door and movable together forward and backward, a second basket positioned above the first basket, and a third basket positioned above the second basket. The cascading basket system includes features that allow a user to pull out the baskets as a single unit and in a cascading manner by moving the door forward. As one example, the first and second baskets can define pocket recesses configured to receive rollers of the seconds and third baskets respectively to engage the baskets. As another example, the first and second baskets can include protruding ribs that receive bosses of the seconds and third baskets respectively to engage the baskets. In another example, the baskets can include magnets to move the baskets forward together as a single unit.

20 Claims, 11 Drawing Sheets

(51) Int. Cl.
*A47B 88/75* (2017.01)
*A47B 88/49* (2017.01)
*F25D 23/02* (2006.01)

(58) Field of Classification Search
USPC ..... 312/402, 404, 330.1, 334.7, 334.12, 350
See application file for complete search history.

(56) References Cited

U.S. PATENT DOCUMENTS 7,712,852 B2 5/2010 Choi et al.
7,950,754 B2 5/2011 Brown et al.
7,950,756 B2 5/2011 Collins et al.
8,002,369 B2 * 8/2011 Bello ..... F25D 25/025 312/410
8,157,338 B2 4/2012 Seo et al.
8,169,175 B2 5/2012 Yu et al.
8,220,886 B2 7/2012 Han et al.
8,333,447 B2 12/2012 Moody
8,424,693 B1 4/2013 Hoover
9,146,053 B2 * 9/2015 Nam ..... F25D 25/025
9,322,592 B2 4/2016 Kim et al.
9,464,841 B2 10/2016 Choo et al.
9,513,049 B2 12/2016 Eisele et al.
9,625,204 B2 4/2017 Kim et al.
9,638,459 B2 5/2017 Choi et al.
9,677,807 B2 6/2017 Shin
2004/0164654 A1 * 8/2004 Laible ..... F25D 25/025 312/122
2006/0218958 A1 * 10/2006 Rand ..... F25D 11/022 62/302
2010/0320890 A1 * 12/2010 Jung ..... F25D 27/00 312/402
2011/0006656 A1 * 1/2011 Nam ..... F25D 25/025 312/404
2012/0262045 A1 10/2012 Cheng
2013/0264928 A1 * 10/2013 Hong ..... F25D 25/025 312/404
2015/0033786 A1 2/2015 Mansfield et al.
2015/0145393 A1 5/2015 Young
2015/0377548 A1 * 12/2015 Nam ..... F25D 25/025 312/404
2016/0153704 A1 6/2016 Burke et al.
2016/0209107 A1 * 7/2016 Choi ..... F25D 25/025
2017/0086584 A1 3/2017 Rehage
2017/0227281 A1 * 8/2017 Yang ..... F25D 25/025
2018/0038631 A1 2/2018 Yang et al.
2018/0038632 A1 2/2018 Yang et al.
2018/0100690 A1 * 4/2018 Gatter ..... A47B 88/447

FOREIGN PATENT DOCUMENTS

JP 2011062416 * 3/2011
JP 6434251 * 12/2018
KR 20080084782 A 9/2008
KR 20140074520 A 6/2014

* cited by examiner

APPLIANCE EQUIPPED WITH A CASCADING BASKET SYSTEM

FIELD OF THE INVENTION

The present subject matter relates generally to appliances equipped with cascading basket systems.

BACKGROUND OF THE INVENTION

Some appliances include basket systems for storing items in a chamber or storage compartment of the appliance. For instance, some refrigerator appliances include a freezer chamber that is accessible by a freezer door. For bottom mount refrigerator appliances, the freezer door can be pulled forward or pushed backward to provide selective access to the freezer chamber. In some instances, multiples baskets or pans can be situated within the freezer compartment one on top of the other. The lower basket is typically connected with the freezer door and slides out when the freezer door is pulled forward. However, the one or more baskets positioned above the lower basket in the freezer chamber can be difficult to access. For example, to pull out a basket positioned above the lower basket, a user must bend over and reach into the freezer chamber and grab the basket to pull or slide the basket forward. In some instances, the basket can be full of food items, making it strenuous for the user to pull out the basket. Further, baskets positioned above the lower basket can be hard to view from a comfortable vantage point, and thus, users can forget about food items placed in the baskets and/or that the baskets exist.

Accordingly, an appliance with an improved basket system that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one aspect, an appliance is provided. The appliance includes a housing defining a chamber. The appliance also includes a door movable forward and backward for providing selective access to the chamber. Further, the appliance includes a cascading basket system. The cascading basket system includes a first basket connected to the door and operable to travel forward and backward together with the door, wherein the first basket has a first guide rail that defines a first pocket recess. Further, the cascading basket system includes a second basket operable to travel forward and backward and having a second guide rail that defines a second pocket recess, wherein the second basket has a roller operable to roll along the first guide rail of the first basket and is receivable within the first pocket recess such that the second basket is moved together with the door and the first basket for a first predetermined distance when the door is moved forward. In addition, the cascading basket system includes a third basket operable to travel forward and backward and having a roller operable to roll along the second guide rail of the second basket and is receivable within the second pocket recess such that the third basket is moved together with the door, the first basket, and the second basket for a second predetermined distance when the door is moved forward.

In another aspect, an appliance is provided. The appliance includes a housing defining a chamber. The appliance also includes a door movable forward and backward for providing selective access to the chamber. Further, the appliance includes a cascading basket system. The cascading basket system includes a first basket connected to the door and operable to travel forward and backward together with the door, wherein the first basket has a first guide rail that defines a first roller path and has a protruding rib offset from the first roller path. Moreover, the cascading basket system includes a second basket operable to travel forward and backward, wherein the second basket has a roller connected to the second basket by a second boss, the roller of the second basket operable to roll along the first roller path of the first guide rail and the second boss of the second basket is operable to engage the first protruding rib such that the second basket is moved together with the door and the first basket for a first predetermined distance when the door is moved forward.

In yet another aspect, an appliance is provided. The appliance includes a housing defining a chamber. The appliance also includes a door movable forward and backward for providing selective access to the chamber. Further, the appliance includes a cascading basket system. The cascading basket system includes a first basket connected to the door and operable to travel forward and backward together with the door, wherein the first basket has a first magnet and a first guide rail that defines a first roller path. In addition, the cascading basket system includes a second basket operable to travel forward and backward, wherein the second basket has a roller operable to roll along the first roller path of the first guide rail, and wherein the second basket also has a second magnet oriented such that the first magnet and the second magnet are arranged in opposing polarity so that the second basket is moved forward when the door is moved forward.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
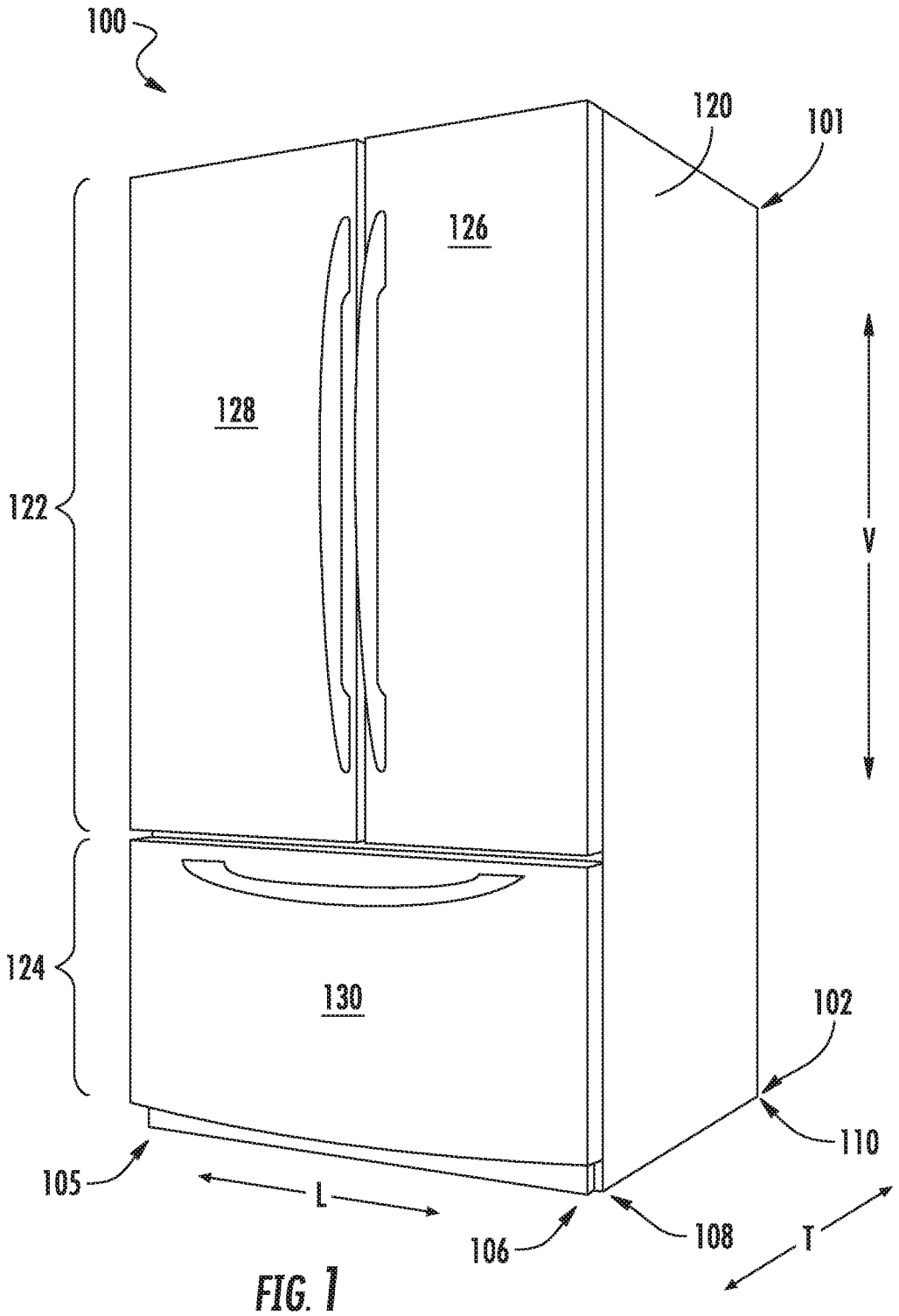
FIG. 1 provides a front perspective view of a refrigerator appliance according to example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an example appliance that may incorporate various inventive aspects of the present subject matter. Particularly, FIG. 1 provides a perspective view of a refrigerator appliance 100. Refrigerator appliance 100 includes a cabinet or housing 120 that extends between a top or upper portion 101 and a bottom or bottom portion 102 along a vertical direction V. Housing 120 also extends between a first side 105 and a second side 106 along a lateral direction L and between a front 108 and a back 110 along a transverse direction T. In this example, the first side 105 is a left side of refrigerator appliance 100 and the second side 106 is a right side of refrigerator appliance 100. The vertical direction V, lateral direction L, and transverse direction T are mutually perpendicular and form an orthogonal direction system.

Housing 120 defines chilled chambers for receipt of food items for storage. In particular, refrigerator appliance 100 defines a fresh food chamber 122 at upper portion 101 of refrigerator appliance 100 and a freezer chamber 124 arranged below fresh food chamber 122 along the vertical direction V, e.g., at bottom portion 102 of refrigerator appliance 100. As such, refrigerator appliance 100 is generally referred to as a bottom mount refrigerator appliance. However, using the teachings disclosed herein, one of skill in the art will appreciate that the teachings of the present disclosure may be used with other types of refrigerator appliances (e.g., side-by-side style or top mount style) or a freezer appliance. Moreover, it will be appreciated that the teachings of the present disclosure may be used with any suitable appliance having a storage compartment or chamber. Consequently, the description set forth herein is for illustrative purposes only and is not intended to limit the present subject matter in any aspect.

Figure 2:
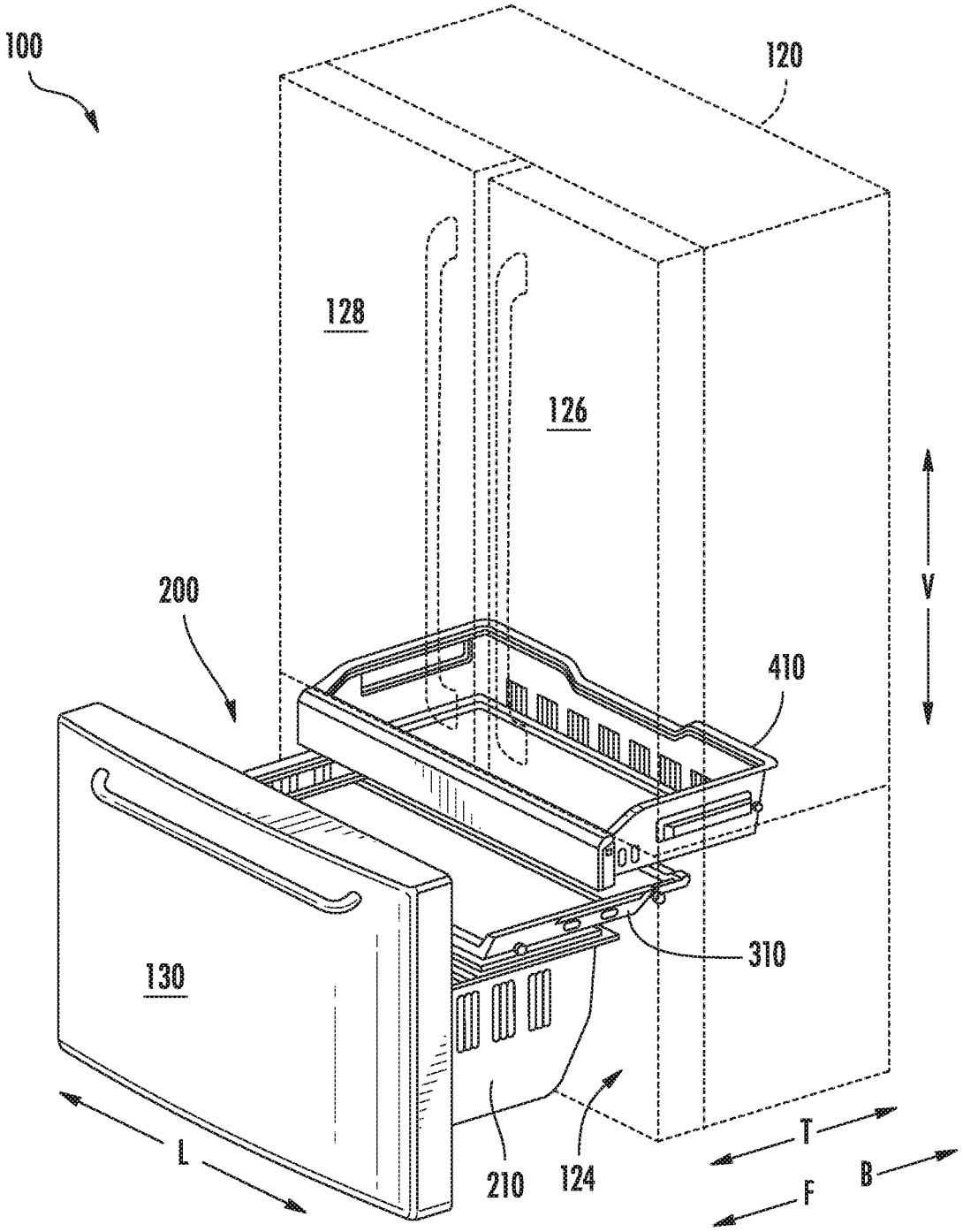
FIG. 2 provides a front perspective view of the refrigerator appliance of FIG. 1 depicts a cascading basket system thereof.

Refrigerator doors 126 and 128 are rotatably hinged to an edge of housing 120 for accessing fresh food compartment 122. In particular, refrigerator doors 126, 128 are rotatably mounted to cabinet 120 to permit selective access to fresh food chamber 122. A freezer door 130 is arranged below refrigerator doors 126, 128 along the vertical direction V. Freezer door 130 is movable forward and backward for providing selective access to freezer chamber 124. That is, freezer door 130 is movable forward and backward along the transverse direction T. Particularly, freezer door 130 is movable between a closed position (shown in FIG. 1) and an open position (FIG. 2). Freezer door 130 can be pulled forward along the transverse direction T to move freezer door 130 from the closed position to the open position and can be pushed backward along the transverse direction T to move freezer door 130 from the open position to the closed position. Accordingly, for this embodiment, freezer door 130 is slideably mounted to housing 120.

FIG. 2 provides a front perspective view of the refrigerator appliance 100 of FIG. 1 and depicts a cascading basket system 200 thereof. In FIG. 2, housing 120 is shown transparent for illustrative purposes. As shown, cascading basket system 200 includes a plurality of baskets each operable to hold food items for storage within freezer chamber 124. For this embodiment, cascading basket system 200 includes a first basket 210, a second basket 310, and a third basket 410. The first basket 210 is a bottom basket, the second basket 310 is a middle basket positioned above the first basket 210 (bottom basket) along the vertical direction V, and the third basket 410 is a top basket positioned above the second basket 310 (middle basket) along the vertical direction V.

Each basket 210, 310, 410 is movable forward and backward along the transverse direction T. The forward direction is denoted by the arrow labeled "F" and the backward direction is denoted by the arrow labeled "B" in FIG. 2. First basket 210 is connected to freezer door 130 and is operable to travel forward and backward together with freezer door 130, e.g., when freezer door 130 is pulled forward or pushed backward along the transverse direction T. When freezer door 130 and first basket 210 are pulled forward along the transverse direction T a distance, first basket 210 engages second basket 310. Once engaged with first basket 210, second basket 310 moves forward together with freezer door 130 and first basket 210 along the transverse direction T. After freezer door 130, first basket 210, and second basket 310 travel forward a distance, second basket 310 engages third basket 410. Once engaged with second basket 310, third basket 410 moves forward together with freezer door 130, first basket 210, and second basket 310 along the transverse direction T. Accordingly, when freezer door 130 is moved forward along the transverse direction T from the closed position (FIG. 1) to the open position (FIG. 2), the first, second, and third baskets 210, 310, 410 are pulled forward together as a single unit for at least a portion of the transverse travel of freezer door 130.

As freezer door 130 is pulled further forward along the transverse direction T, third basket 410 is eventually pulled forward to a fully withdrawn position. When third basket 410 is fully withdrawn, second basket 310 eventually disengages from third basket 410 and continues sliding forward along the transverse direction T until eventually second basket 310 is pulled forward to a fully withdrawn position. When second basket 310 is fully withdrawn, first basket 210 eventually disengages from second basket 310 and continues sliding forward together with freezer door 130 along the transverse direction T until eventually first basket 210 is pulled forward to a fully withdrawn position. When each of the first, second, and third baskets 210, 310, 410, are in their respective fully withdrawn positions (FIGS. 3 and 4), the first basket 210 is positioned forward of the second basket 310, e.g., along the transverse direction T, and the second basket 310 is positioned forward of the third basket 410, e.g., along the transverse direction T. In this way, a user may view the contents of each basket 210, 310, 410 at the same time. That is, the cascading arrangement of the baskets 210, 310, 410 in their fully withdrawn positions provides an improved vantage point for viewing the contents within the baskets 210, 310, 410. Moreover, as the baskets 210, 310, 410 are pulled out as a single unit, a user can pull on freezer door 130 to view all of the contents within baskets 210, 310, 410 without need to physically pull on any of the baskets directly.

To return the baskets 210, 310, 410 to their respective storage positions within freezer chamber 124, freezer door 130 can be pushed or otherwise moved backward along the transverse direction T. As this occurs, the freezer door 130 engages the front portion of each basket 210, 310, 410 and moves the baskets 210, 310, 410 to their respective storage positions within freezer chamber 124.

Figure 3:
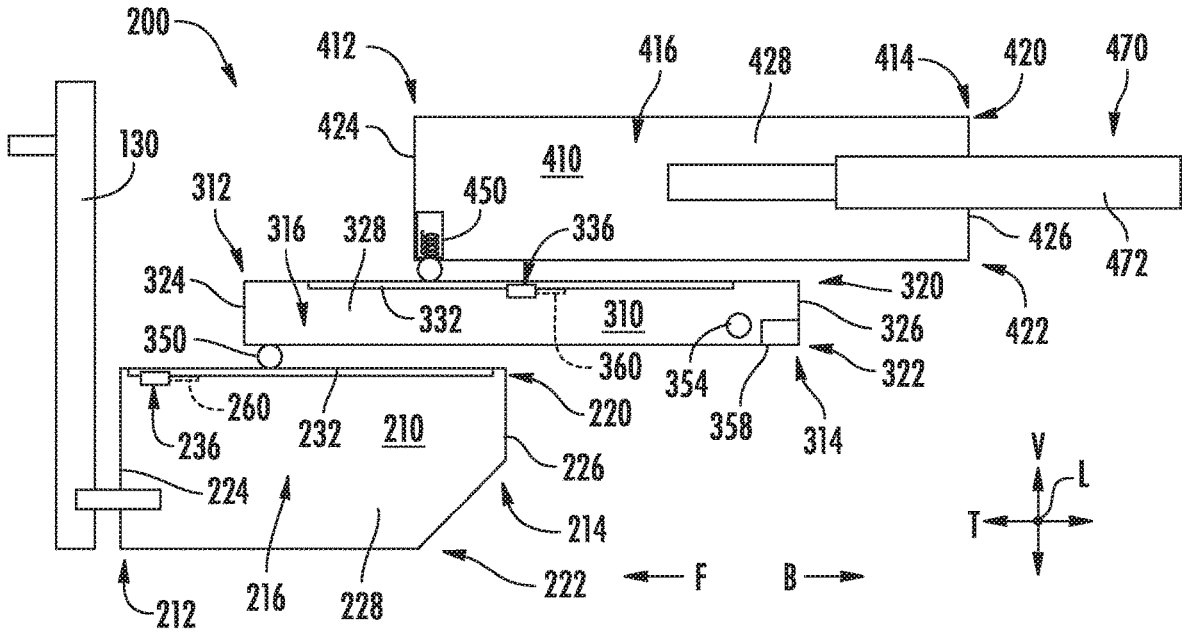
FIG. 3 provides a left side schematic view of the cascading basket system of FIG. 2.
Figure 4:
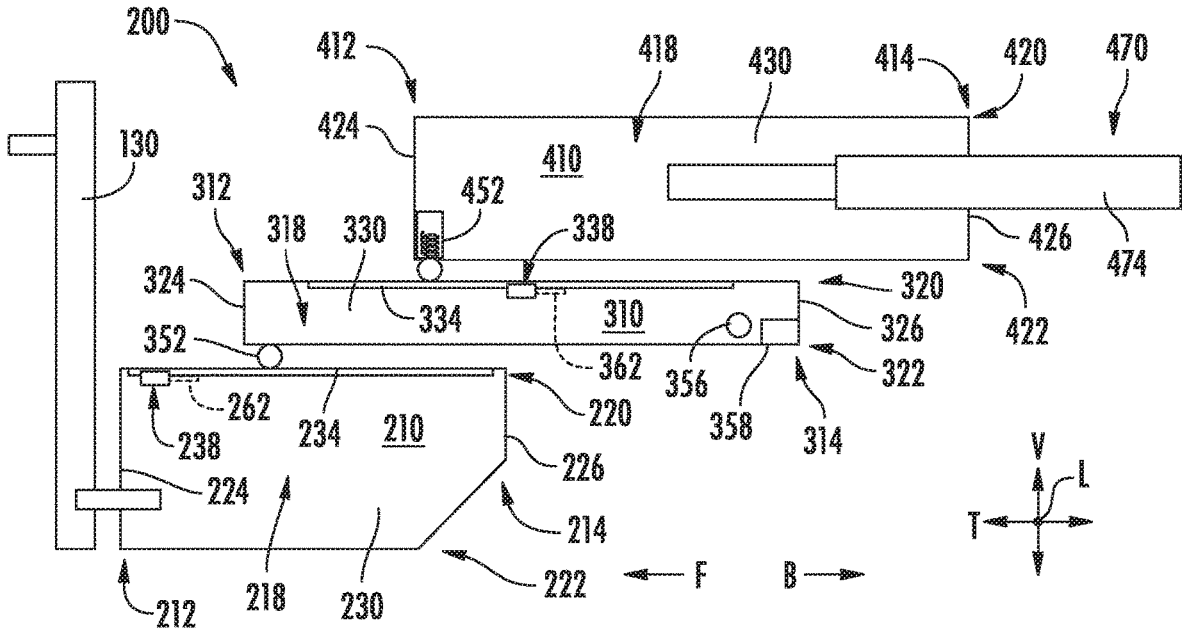
FIG. 4 provides a right side schematic view of the cascading basket system of FIG. 2.

FIGS. 3 and 4 provide left and right side schematic views of the cascading basket system 200 of FIG. 2, respectively, and depict various features of cascading basket system 200 that facilitate engagement of the baskets 210, 310, 410 during transverse forward travel such that the baskets 210, 310, 410 can be pulled forward or out as a single unit as described above.

As shown, first basket 210 extends between a front 212 and back 214, e.g., along the transverse direction T, and a left side 216 (FIG. 3) and a right side 218 (FIG. 4), e.g., along the lateral direction L. First basket 210 is connected to freezer door 130 at front 212, e.g., via one or more bracket assemblies. First basket 210 also extends between a top 220 and a bottom 222, e.g., along the vertical direction V. Similarly, second basket 310 extends between a front 312 and back 314, e.g., along the transverse direction T, and a left side 316 (FIG. 3) and a right side 318 (FIG. 4), e.g., along the lateral direction L. Second basket 310 also extends between a top 320 and a bottom 322, e.g., along the vertical direction V. Further, third basket 410 extends between a front 412 and a back 414, e.g., along the transverse direction T, and a left side 416 (FIG. 3) and a right side 418 (FIG. 4), e.g., along the lateral direction L. Third basket 410 also extends between a top 420 and a bottom 422, e.g., along the vertical direction V.

Figure 5:
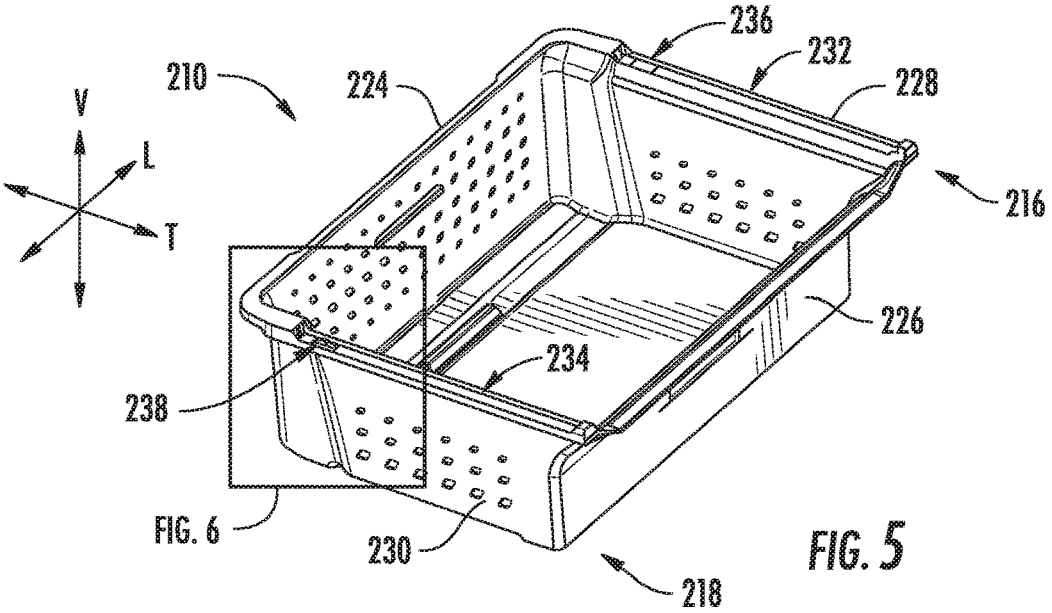
FIG. 5 provides a perspective view of a first basket of the cascading basket system of FIG. 2.

FIG. 5 provides a perspective view of first basket 210 of the cascading basket system 200. As shown, first basket 210 has a front wall 224, a back wall 226 spaced from front wall 224 along the transverse direction T, a left sidewall 228 extending between and connecting front wall 224 and back wall 226 at left side 216, and a right sidewall 230 extending between and connecting front wall 224 and back wall 226 at right side 218. Left sidewall 228 is spaced from right sidewall 230 along the lateral direction L.

First basket 210 has a first left guide rail 232 that extends longitudinally along the transverse direction T at the left side 216 of first basket 210, e.g., along a top portion of left sidewall 228. First left guide rail 232 defines a roller path along which a roller of second basket 310 may roll. Further, first basket 210 has a first right guide rail 234 that extends longitudinally along the transverse direction T at the right side 218 of first basket 210, e.g., along a top portion of right sidewall 230. First right guide rail 234 defines a roller path along which a roller of second basket 310 may roll. Notably, first left guide rail 232 and first right guide rail 234 of first basket 210 each define pocket recesses. Particularly, left guide rail 232 defines a first left pocket recess 236 and right guide rail 234 defines a first right pocket recess 238. As will be explained below, rollers of second basket 310 (FIGS. 3 and 4) are receivable within the first pocket recesses 236, 238 such that second basket 310 is moved together with freezer door 130 and first basket 210 for a first predetermined distance when freezer door 130 is moved forward along the transverse direction T.

Figure 6:
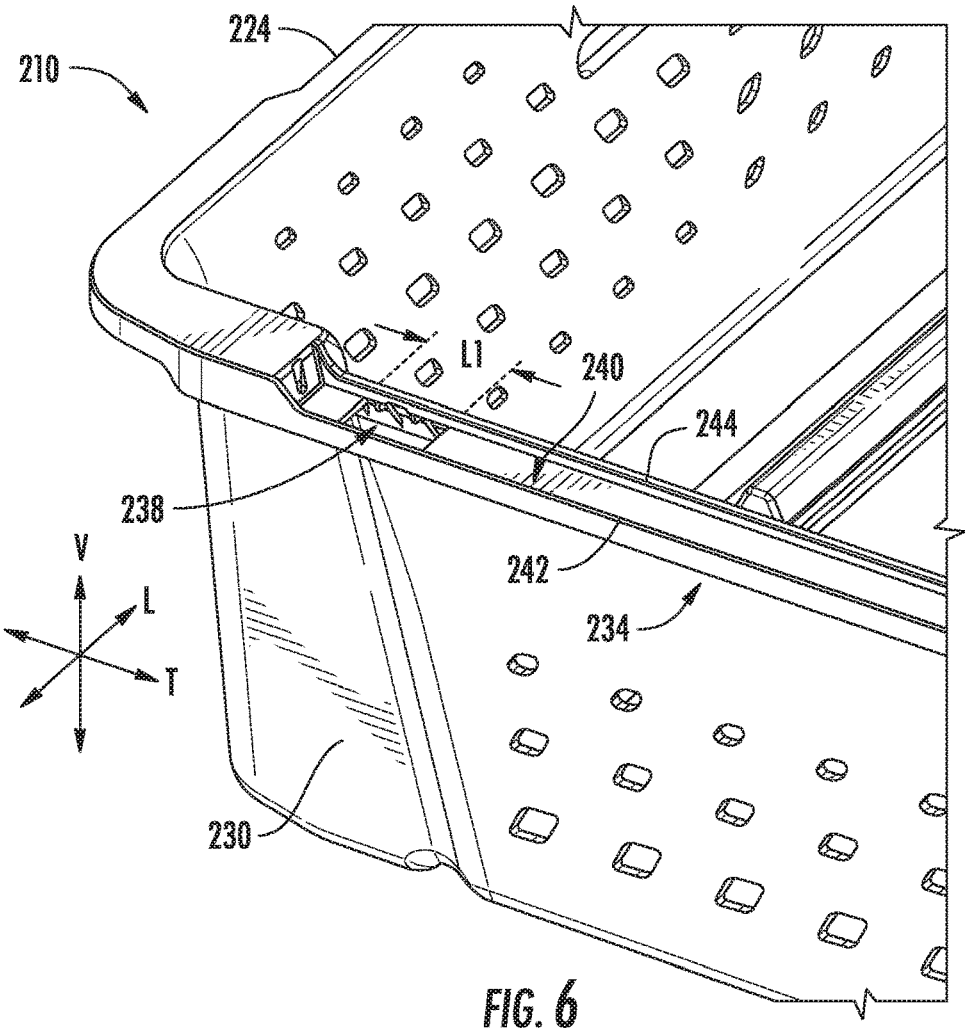
FIG. 6 provides a close up perspective view of the first basket of FIG. 5.

FIG. 6 provides a close up perspective view of first basket 210, and more particularly, FIG. 6 provides a close up view of first right pocket recess 238 defined by first right guide rail 234. As illustrated in FIG. 6, first right guide rail 234 includes a roller surface 240 along which a roller can roll. First right guide rail 234 also includes opposing rims 242, 244 that prevent the roller from going off or derailing from roller surface 240. Roller surface 240 is recessed with respect to the top edges of the opposing rims 242, 244 along the vertical direction V. Roller surface 240 and opposing rims 242, 244 collectively define the roller path. First left guide rail 232 (FIG. 5) is configured similar to first right guide rail 234 as described above.

Further, as depicted, first right pocket recess 238 is defined generally as a rectangular cutout in roller surface 240 of first right guide rail 234. For this embodiment, first right pocket recess 238 is defined at a front portion of first right guide rail 234. First right pocket recess 238 is sized to receive at least a portion of a roller therein. Particularly, first right pocket recess 238 defined by first right guide rail 234 has a transverse length L1 that is less than a diameter D1 (FIG. 9) of a front right roller 352 (FIG. 9) of second basket 310. In this way, when front right roller 352 of second basket 310 "pockets" or is received within first right pocket recess 238, front right roller 352 does not fall through first right pocket recess 238. The depth in which front right roller 352 pockets or is received within first right pocket recess 238, and consequently the force required to move or disengage the roller from the pocket recess, can be controlled by the transverse length L1 of the pocket recess and the diameter of the roller. First left pocket recess 236 (FIG. 5) is defined similar to first right pocket recess 238 as described above.

Returning now to FIGS. 3 and 4, second basket 310 has a front wall 324, a back wall 326 spaced from front wall 324 along the transverse direction T, a left sidewall 328 (FIG. 3) extending between and connecting front wall 324 and back wall 326 at left side 316, and a right sidewall 330 (FIG. 4) extending between and connecting front wall 324 and back wall 326 at right side 318. Left sidewall 328 is spaced from right sidewall 330 along the lateral direction L.

Second basket 310 includes a plurality of rollers. Particularly, second basket 310 includes a front left roller 350 (FIG. 3), front right roller 352 (FIG. 4), a back left roller 354 (FIG. 3), and a back right roller 356 (FIG. 4). Front left roller 350 is positioned forward of back left roller 354 along the transverse direction T and front right roller 352 is positioned forward of back right roller 356 along the transverse direction T. Moreover, front left roller 350 can be aligned with front right roller 352 along the transverse direction T and back left roller 354 can be aligned with back right roller 356 along the transverse direction T. In addition, front left roller 350 can be aligned with back left roller 354 along the lateral direction L and front right roller 352 can be aligned with back right roller 356 along the lateral direction L. Back left and right rollers 354, 356 can be positioned about midway between the top 320 and bottom 322 of second basket 310. In addition, as shown in FIGS. 3 and 4, stops 358 can be positioned at the back 314 of second basket 310 at left side 316 and right side 318. The stops 358 can catch on respective guide rails defined by a liner of housing 120 (FIG. 2), e.g., to constrain the forward transverse travel of second basket 310 and also to prevent second basket 310 from damaging the back wall of housing 120 when second basket 310 is moved to the storage position within freezer chamber 124 (FIG. 2).

The back left roller 354 and the back right roller 356 slideably couple second basket 310 with housing 120 (FIG. 2). For instance, the back left roller 354 and the back right roller 356 can travel along a guide rail defined by a liner of the housing 120. Front left roller 350 is operable to roll along the first left guide rail 232 of first basket 210 and front right roller 352 is operable to roll along the first right guide rail 234 of first basket 210. Notably, front left roller 350 is receivable within first left pocket recess 236 and front right roller 352 is receivable within first right pocket recess 238 such that second basket 310 is moved together with freezer door 130 and first basket 210 for a first predetermined distance when freezer door 130 and first basket 210 are moved forward along the transverse direction T.

Like first basket 210, second basket 310 includes guide rails. Particularly, second basket 310 has a second left guide rail 332 that defines a second left pocket recess 336 and a second right guide rail 334 that defines a second right pocket recess 338. The second left guide rail 332 and second right guide rail 334 can be similarly configured as the first left guide rail 232 and first right guide rail 234 of first basket 210, except that the second left guide rail 332 and second right guide rail 334 define their respective pocket recesses 336, 338 at about the midway point between the front 312 and back 314 of second basket 310. Moreover, notably, second left pocket recess 336 is defined by second left guide rail 332 between front left roller 350 and back left roller 354 along the transverse direction T and second right pocket recess 338 is defined by second right guide rail 334 between front right roller 352 and back right roller 356 along the transverse direction T. Orienting the second pocket recesses 336, 338 in such a manner provides enhanced stability for second basket 310.

In addition, second pocket recesses 336, 338 are each sized to receive at least a portion of a roller therein. Particularly, second pocket recesses 336, 338 each have a transverse length L1 that is less than the diameter of a roller of third basket 410 received therein. In this way, when rollers of third basket 410 "pocket" or are received within their respective pocket recesses 336, 338, the rollers do not fall through the recesses 336, 338.

As further shown in FIGS. 3 and 4, third basket 410 has a front wall 424, a back wall 426 spaced from front wall 424 along the transverse direction T, a left sidewall 428 extending between and connecting front wall 424 and back wall 426 at left side 416, and a right sidewall 430 extending between and connecting front wall 424 and back wall 426 at right side 418. Moreover, for this embodiment, third basket 410 is operatively coupled with housing 120 (FIG. 2) via a slide assembly 470. Particularly, third basket 410 is slideably coupled with housing 120 by a left slide 472 at left side 416 and a right slide 474 at right side 418 of third basket 410. Left slide 472 can be connected to a liner of housing 120 at first side 105 (e.g., the left side) of refrigerator appliance 100 (FIG. 1) and right slide 474 can be connected to the liner of housing 120 at second side 106 (e.g., the right side) of refrigerator appliance 100. Slide assembly 470 facilitates forward and backward movement of third basket 410 and maintains third basket 410 in a horizontal plane (i.e., a plane orthogonal to the vertical direction V) throughout its transverse travel.

Third basket 410 also includes a plurality of rollers. Particularly, for this embodiment, third basket 410 includes a front left roller 450 (FIG. 3) and a front right roller 452 (FIG. 4). Front left roller 450 is operable to roll along a roller surface of second left guide rail 332 of second basket 310 and front right roller 452 is operable to roll along a roller surface of second right guide rail 334 of second basket 310. Notably, front left roller 450 is receivable within second left pocket recess 336 and front right roller 452 is receivable within second right pocket recess 338 such that third basket 410 is moved together with freezer door 130, first basket 210, and second basket 310 for a second predetermined distance when freezer door 130, first basket 210, and second basket 310 are moved forward along the transverse direction T.

Furthermore, for this embodiment, front left roller 450 is a spring-loaded roller that is biased in contact with the second left guide rail 332 of second basket 310 and front right roller 452 is also a spring-loaded roller that is biased in contact with second right guide rail 334 of second basket 310. Particularly, a spring housed in a chamber defined by front wall 424 can bias front left roller 450 against second left guide rail 332 and a spring housed in a chamber defined by front wall 424 can bias front right roller 452 against second right guide rail 334. The spring-loaded rollers 450, 452 account for changes in vertical height between third basket 410 and second basket 310. That is, when second basket 310 travels along the transverse direction T, particularly when second basket 310 is moved forward, the front 312 of second basket 310 can tilt downward along the vertical direction V. As third basket 410 is slideably coupled with housing 120 (FIG. 2) via slide assembly 470 and thus travels in a horizontal plane, the vertical distance between third basket 410 and second basket 310 can vary over the transverse direction T. Accordingly, the spring-loaded rollers 450, 452 account for this vertical height delta and ensure that constant contact is achieved between rollers 450, 452 and their respective guide rails 332, 334 through the transverse travel of the baskets 310, 410.

Figure 7:
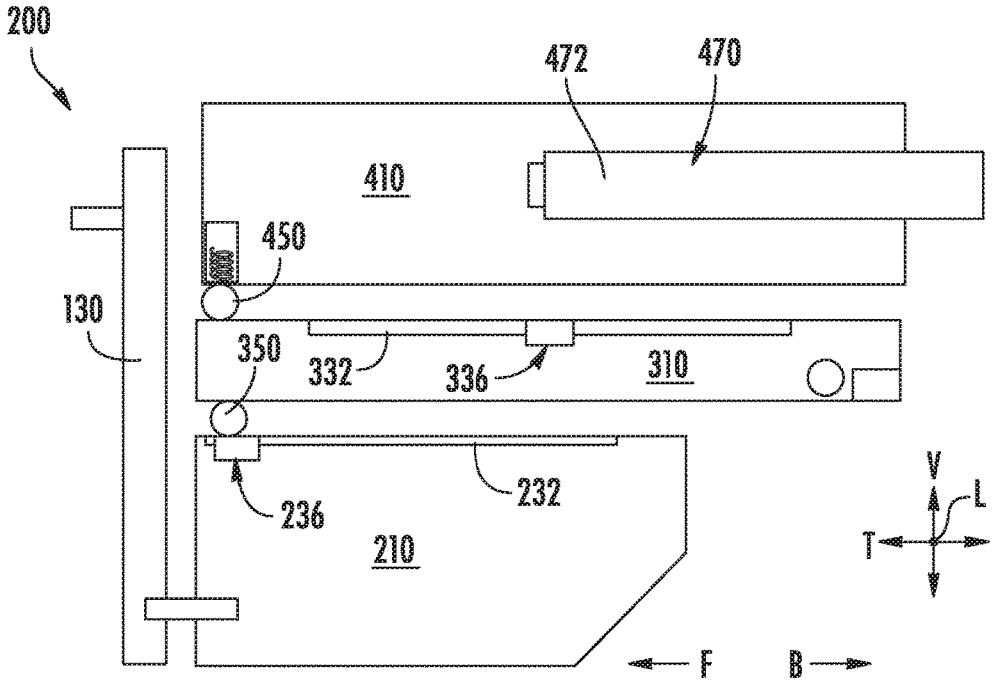
FIG. 7 provides a left side schematic view of the cascading basket system of FIG. 2 and depicts baskets of the system in a storage position.

With reference generally now to FIGS. 3, 4, 7, and 8, the cascading basket system 200 can be moved forward along the transverse direction T as a single unit and withdrawn in a cascading arrangement in the following example manner. FIG. 7 provides a left side schematic view of the cascading basket system 200 and depicts baskets 210, 310, 410 in their respective storage positions within freezer chamber 124 (FIG. 2). To commence withdrawing baskets 210, 310, 410 from their respective storage positions, freezer door 130 is moved forward (e.g., pulled out) from its closed position (FIG. 1). As first basket 210 is connected with freezer door 130 (e.g., via one or more bracket assemblies), first basket 210 is moved forward together with freezer door 130 along the transverse direction T. The forward direction is denoted by the arrow labeled "F" in FIGS. 7 and 8.

Figure 9:
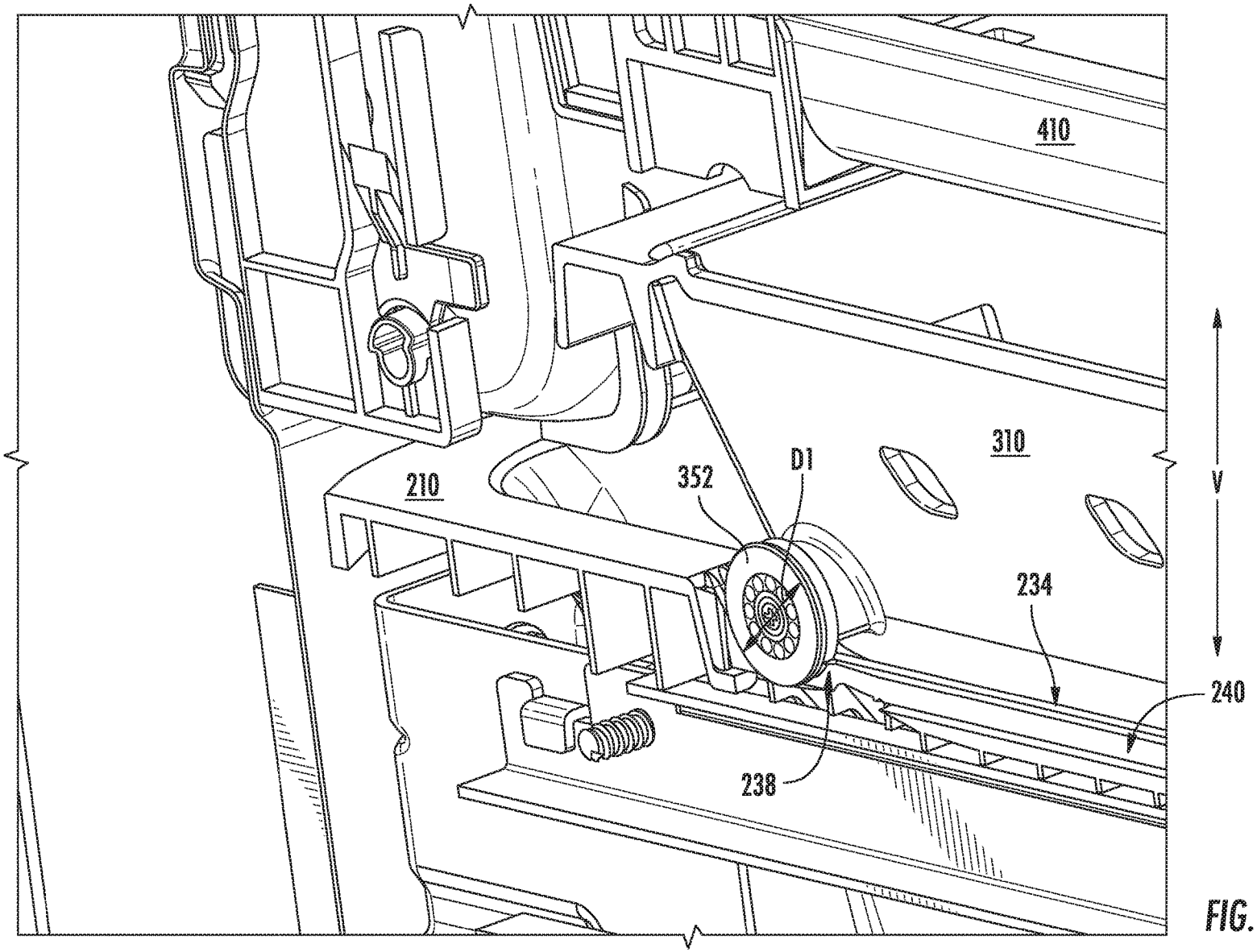
FIG. 9 provides a perspective view of a roller of a second basket received within a pocket recess of the first basket of the cascading basket system of FIG. 2.

After first basket 210 and freezer door 130 are moved forward a short distance along the transverse direction T, first basket 210 and second basket 310 engage. That is, front left roller 350 of second basket 310 drops into or is otherwise received by first left pocket recess 236 defined by first left guide rail 232, and at the same time, front right roller 352 (FIG. 4) of second basket 310 drops into or is otherwise received by first right pocket recess 238 (FIG. 4) defined by first right guide rail 234 (FIG. 4). For example, FIG. 9 provides a perspective view of front right roller 352 of second basket 310 received within first right pocket recess 238 of first basket 210. As depicted, when front right roller 352 is received by first right pocket recess 238, front right roller 352 moves downward along the vertical direction V and engages roller surface 240 at the front of the pocket recess 238 and at the back of the pocket recess 238. As shown, only a portion of front right roller 352 is received within pocket recess 238. Front left roller 350 can be received within pocket recess 236 in a similar fashion. When the rollers 350, 352 drop into their respective recesses 236, 238, first basket 210 is engaged with second basket 310, and as a result, second basket 310 is moved together with freezer door 130 and first basket 210 for a first predetermined distance when freezer door 130 is moved forward along the transverse direction T.

Figure 8:
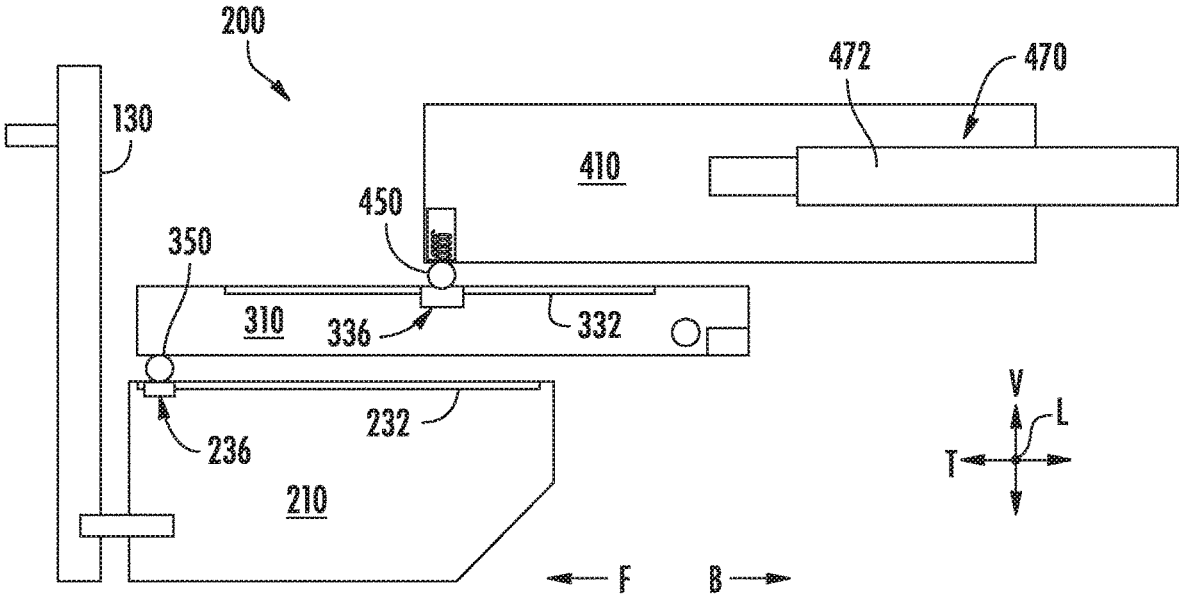
FIG. 8 provides a left side schematic view of the cascading basket system of FIG. 2 and depicts the first basket engaged with the second basket and the second basket engaged with a third basket as the baskets are withdrawn.

As freezer door 130, first basket 210, and second basket 310 are moved forward along the transverse direction T, second basket 310 and third basket 410 engage. More specifically, as shown in FIG. 8, a left side schematic view of the cascading basket system 200 is provided illustrating first basket 210 engaged with second basket 310 and second basket 310 engaged with third basket 410. As shown, when second basket 310 and third basket 410 are engaged, left roller 450 of third basket 410 drops into or is otherwise received by second left pocket recess 336 defined by second left guide rail 332, and at the same time, right roller 452 (FIG. 4) of third basket 410 drops into or is otherwise received by second right pocket recess 338 (FIG. 4) defined by second right guide rail 334 (FIG. 4). Left roller 450 and right roller 452 can be received within their respective pocket recesses 336, 338 in a similar fashion as rollers 350, 352 are received within their respective pocket recesses 236, 238 as described above. When the rollers 450, 452 drop into their respective recesses 336, 338, second basket 310 is engaged with third basket 410, and as a result, third basket 410 is moved together with freezer door 130, first basket 210, and second basket 310 for a second predetermined distance when freezer door 130 is moved forward along the transverse direction T.

As freezer door 130 is pulled further forward along the transverse direction T, third basket 410 eventually disengages from second basket 210. That is, left roller 450 and right roller 452 disengage from their respective pocket recesses 336, 338 when third basket 410 is pulled forward to the fully withdrawn position. Thus, freezer door 130, first basket 210, and second basket 310 continue moving forward together along the transverse direction T without third basket 410. Left roller 450 and right roller 452 can disengage from their respective pocket recesses 336, 338 and can continue rolling along the roller surfaces of the their respective guide rails 332, 334 as freezer door 130, first basket 210, and second basket 310 are moved forward relative to third basket 410.

As freezer door 130 is pulled even further forward along the transverse direction T, second basket 310 eventually disengages from first basket 210. When second basket 310 disengages from first basket 210, front left roller 350 and front right roller 352 disengage from their respective pocket recesses 236, 238 when second basket 310 is pulled forward to the fully withdrawn position. Thus, freezer door 130 and first basket 210 continue moving forward together along the transverse direction T without second basket 310 or third basket 410. Left roller 350 and right roller 352 can disengage from their respective pocket recesses 236, 238 and can continue rolling along the roller surfaces of the their respective guide rails 232, 234 as freezer door 130 and first basket 210 are moved forward relative to second basket 310.

Freezer door 130 is moved further forward along the transverse direction T until eventually first basket 210 is pulled forward to a fully withdrawn position. With first, second, and third baskets 210, 310, 410 in their respective fully withdrawn positions in the cascading arrangement, e.g., as shown in FIGS. 3 and 4, a user may view the contents of each basket 210, 310, 410 at the same time. Moreover, as the baskets 210, 310, 410 are pulled out as a single unit, a user can pull on freezer door 130 to view all of the contents within baskets 210, 310, 410 without need to physically pull on any of the baskets directly.

In some embodiments, with reference generally to FIGS. 3 and 4, the cascading features of cascading basket system 200 can be turned off or otherwise made inoperable so that the baskets 210, 310, 410 can be moved forward or backward along the transverse direction T independently of one another. For instance, in some example embodiments, the cascading features of third basket 410 can be made inoperable. In such embodiments, spring-loaded rollers 450, 452 are lockable in a disengaged position such that the spring-loaded rollers 450, 452 are not receivable in the second pocket recesses 336, 338, respectively. That is, the tension on the springs can be changed so that the rollers 450, 452 are moved slightly upward along the vertical direction V so that they do not engage the pocket recesses 336, 338. Accordingly, when second basket 310 is moved forward together with first basket 210 and freezer door 130, third basket 410 does not engage with second basket 310 and thus third basket 410 can remain in the storage position independently of freezer door 130 and other baskets 210, 310.

Moreover, in some embodiments, all of the cascading features of cascading basket system 200 can be made inoperable. For instance, in such embodiments, first basket 210 includes a first left pocket recess cover 260 (FIG. 3) and a first right pocket recess cover 262 (FIG. 4). First left pocket recess cover 260 and first right pocket recess cover 262 are movable so that they can selectively cover their respective first pocket recesses 236, 238. For this example, first left pocket recess cover 260 is movable between a cover position and a non-cover position. In the cover position, first pocket recess cover 260 covers the first left pocket recess 236 such that front left roller 350 of second basket 310 is not receivable within first left pocket recess 236. Particularly, first left pocket recess cover 260 can be slid forward along the transverse direction T to cover first left pocket recess 236. In this way, front left roller 350 rolls over first left pocket recess cover 260 instead of engaging first left pocket recess 236. Thus, the cascading feature is not operable. In the non-cover position, first left pocket recess cover 260 does not cover first left pocket recess 236 such that front left roller 350 is receivable within first left pocket recess 236. Thus, the cascading feature is operable.

Similarly, first right pocket recess cover 262 is movable between a cover position and a non-cover position. In the cover position, first right pocket recess cover 262 covers the first right pocket recess 238 such that front right roller 352 of second basket 310 is not receivable within first right pocket recess 238. Particularly, first right pocket recess cover 262 can be slid forward along the transverse direction T to cover first right pocket recess 238. In this way, front right roller 352 rolls over first right pocket recess cover 262 instead of engaging first right pocket recess 238. Thus, the cascading feature is not operable. In the non-cover position, first right pocket recess cover 262 does not cover first right pocket recess 238 such that front right roller 352 is receivable within first right pocket recess 238. Thus, the cascading feature is operable.

In some embodiments, second basket 310 includes a second left pocket recess cover 360 (FIG. 3) and a second right pocket recess cover 362 (FIG. 4). Second left pocket recess cover 360 and second right pocket recess cover 362 are movable so that they can selectively cover their respective second pocket recesses 336, 338. Particularly, second left pocket recess cover 360 can selectively cover second left pocket recess 336 in a similar manner as first left pocket recess cover 260 can selectively cover first left pocket recess 236 and second right pocket recess cover 362 can selectively cover second right pocket recess 338 in a similar manner as first right pocket recess cover 262 can selectively cover first right pocket recess 238. In this manner, the cascading features between second basket 310 and third basket 410 can be made operable or inoperable, e.g., at the selection of a user.

Figure 10:
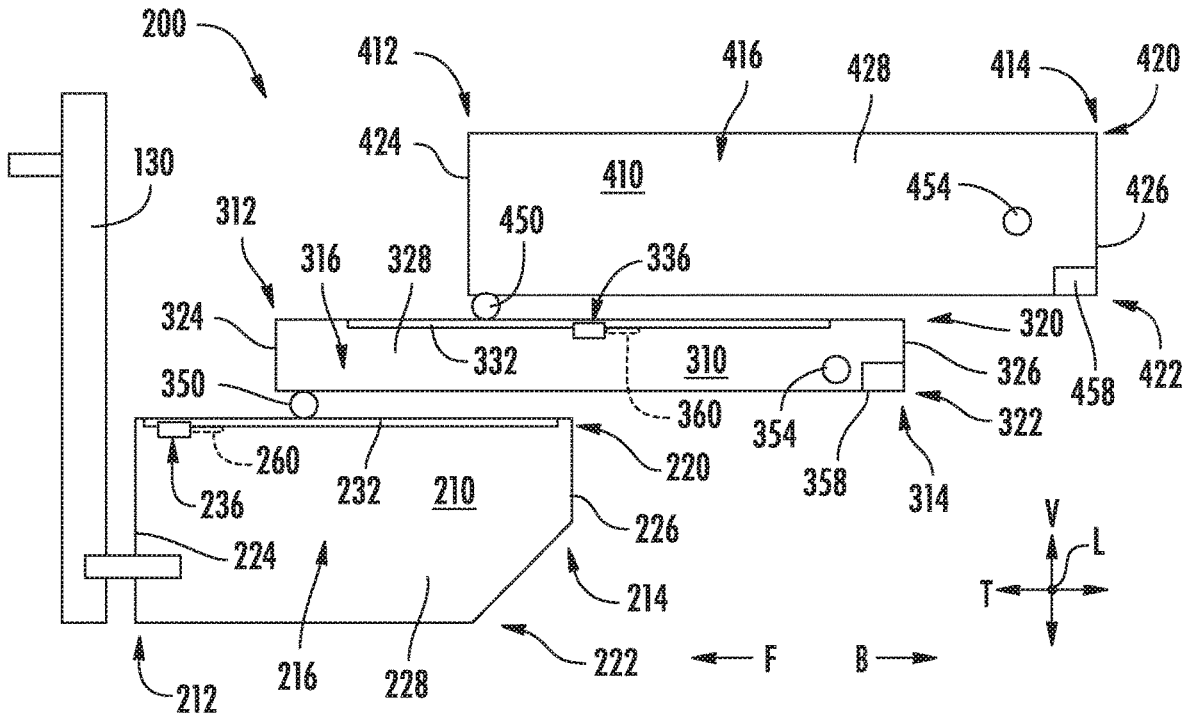
FIG. 10 provides a left side schematic view of another cascading basket system according to example embodiments of the present subject matter.
Figure 11:
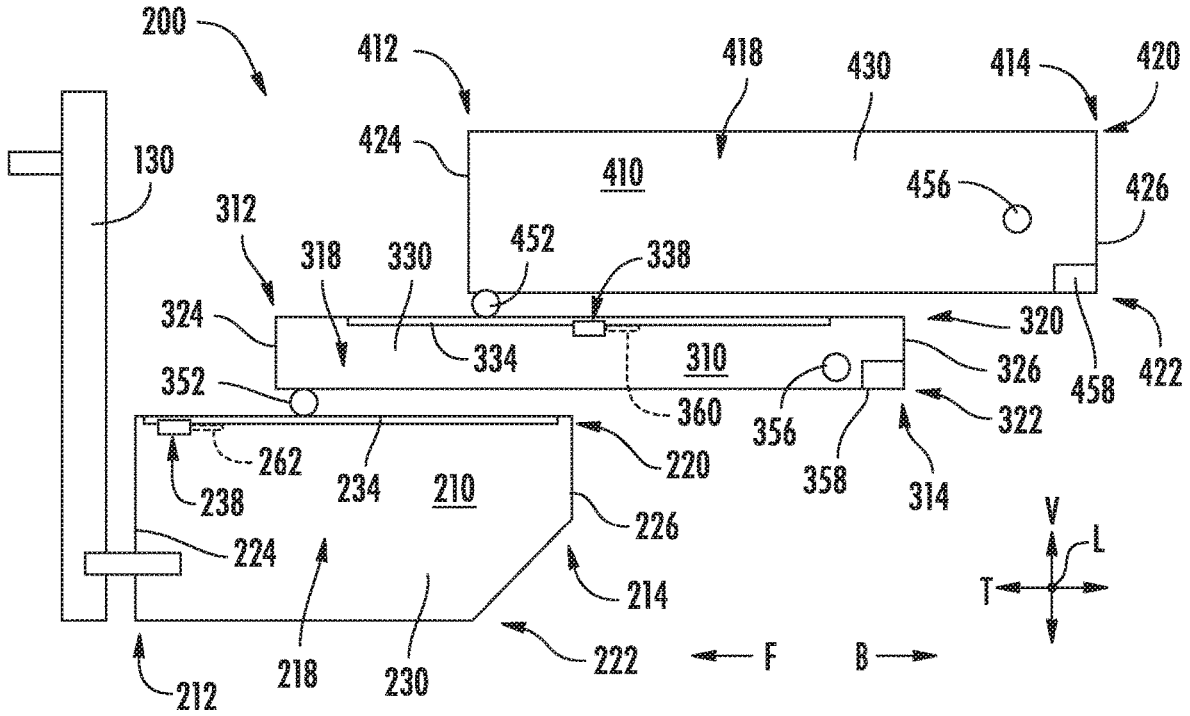
FIG. 11 provides a right side schematic view of the cascading basket system of FIG. 10.

FIGS. 10 and 11 provide schematic views of another embodiment of cascading basket system 200 according to example embodiments of the present subject matter. Particularly, FIG. 10 provides a left side schematic of cascading basket system 200 and FIG. 11 provides a right side schematic view of the cascading basket system 200 of FIG. 10. The cascading basket system 200 of FIGS. 10 and 11 is configured in a similar manner as the cascading basket system of FIGS. 3 through 9 except as provided below.

As shown in FIGS. 10 and 11, instead of slide assembly 170 (FIGS. 3 and 4) operatively coupling third basket 410 with housing 120 (FIG. 2), for this embodiment third basket 410 is operatively coupled with housing 120 via one or more rollers. Particularly, for this embodiment, third basket 310 includes a back left roller 454 (FIG. 10) and a back right roller 456 (FIG. 11) in addition to left roller 450 and right roller 452 (which need not be spring-loaded rollers as shown). Left roller 450 is positioned forward of back left roller 454 along the transverse direction T and right roller 3452 is positioned forward of back right roller 456 along the transverse direction T. Moreover, left roller 450 can be aligned with right roller 452 along the transverse direction T and back left roller 454 can be aligned with back right roller 456 along the transverse direction T. In addition, left roller 450 can be aligned with back left roller 454 along the lateral direction L and right roller 452 can be aligned with back right roller 456 along the lateral direction L. Back left and right rollers 454, 456 can be positioned about midway between the top 420 and bottom 422 of third basket 410. Furthermore, as shown in FIGS. 10 and 11, stops 458 can be positioned at the back 414 of third basket 410 at left side 416 and right side 418. The stops 458 can catch on respective guide rails defined by a liner of housing 120 (FIG. 2), e.g., to constrain the forward transverse travel of third basket 410 and also to prevent third basket 410 from damaging the back wall of housing 120 when third basket 410 is moved to the storage position within freezer chamber 124 (FIG. 2). The back left roller 454 and the back right roller 456 slideably couple third basket 410 with housing 120 (FIG. 2). For instance, the back left roller 454 and the back right roller 456 can travel along a guide rail defined by a liner of the housing 120.

Figure 12:
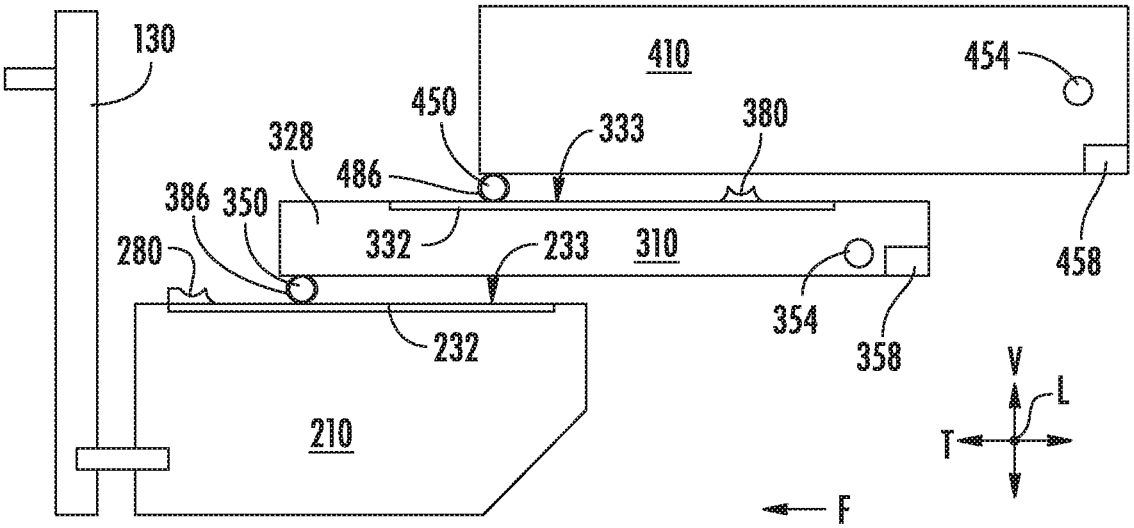
FIG. 12 provides a left side schematic view of yet another cascading basket system according to example embodiments of the present subject matter.
Figure 13:
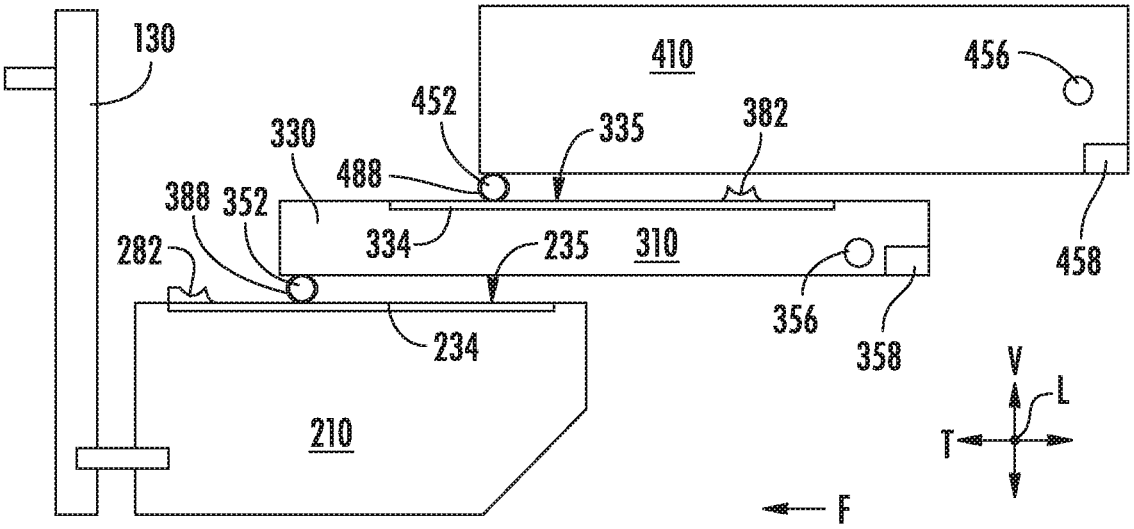
FIG. 13 provides a right side schematic view of the cascading basket system of FIG. 12.
Figure 14:
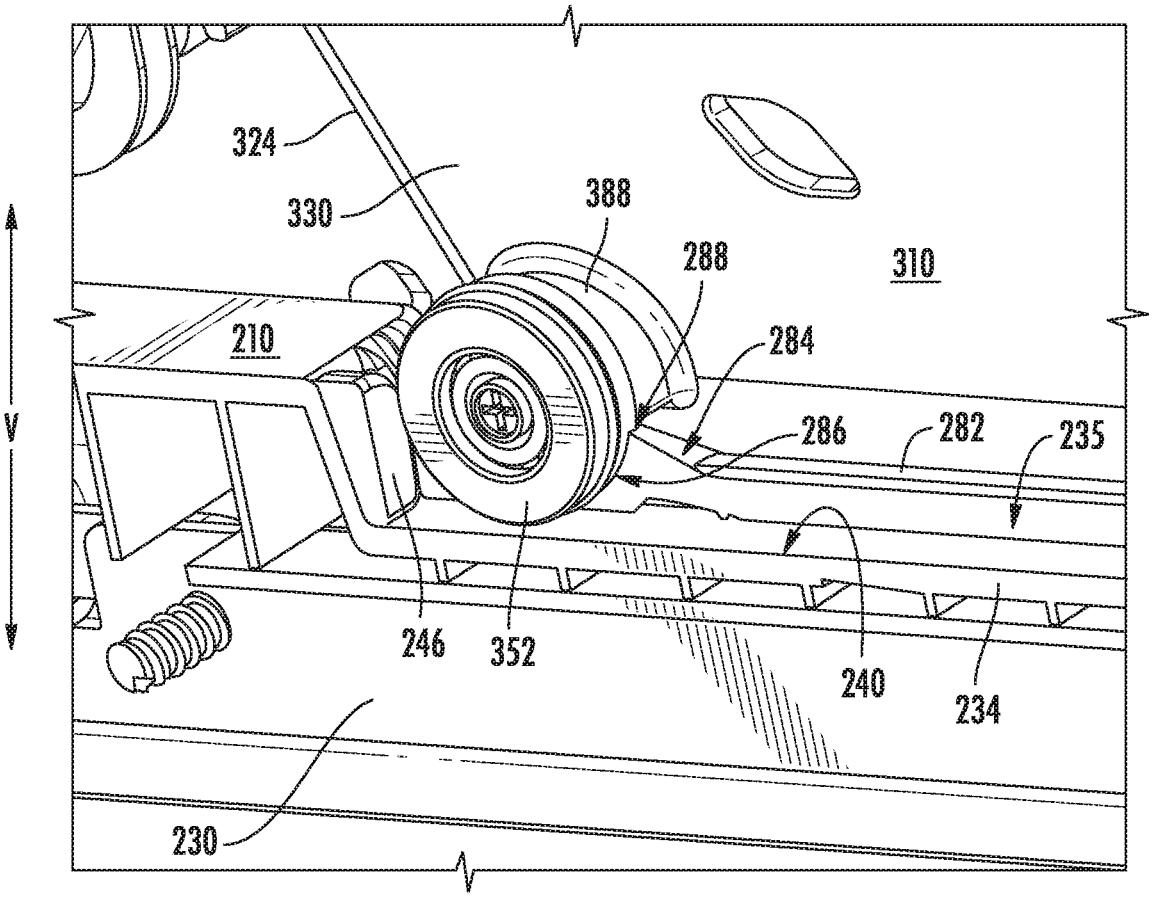
FIG. 14 provides a close up perspective view of a boss of a basket received within a pocket of a protruding rib of another basket of the cascading basket system of FIG. 12.

FIGS. 12, 13, and 14 provide views of yet another embodiment of cascading basket system 200 according to example embodiments of the present subject matter. Particularly, FIG. 12 provides a left side schematic of cascading basket system 200 and FIG. 13 provides a right side schematic view of the cascading basket system 200 of FIG. 12. FIG. 14 provides a close up perspective view of a boss of first basket 210 received by a protruding rib of second basket 310 of the cascading basket system 200 of FIGS. 12 and 13. The cascading basket system 200 of FIGS. 12, 13, and 14 is configured in a similar manner as the cascading basket system of FIGS. 3 through 9 except as provided below.

As shown in FIGS. 12 and 13, instead of pocket recesses defined by guide rails 232, 234, 332, 334, for this embodiment, first left guide rail 232 of first basket 210 has a left protruding rib 280 (FIG. 12) and first right guide rail 234 of first basket 210 has a right protruding rib 282 (FIG. 13). Further, second left guide rail 332 of second basket 310 has a left protruding rib 380 (FIG. 12) and second right guide rail 334 of second basket 310 has a right protruding rib 382 (FIG. 13). As noted previously, first left guide rail 232, first right guide rail 234, second left guide rail 332, and second right guide rail 334 all define roller paths along which rollers can roll to slide the baskets 210, 310, 410 forward and backward along the transverse direction T. Notably, left protruding rib 280 is offset from a roller path 233 (FIG. 12) defined by first left guide rail 232, right protruding rib 282 is offset from a roller path 235 (FIG. 13) defined by first right guide rail 234, left protruding rib 380 is offset from a roller path 333 (FIG. 12) defined by second left guide rail 332, and right protruding rib 382 is offset from a roller path 335 (FIG. 13) defined by second right guide rail 334. For instance, each protruding rib 280, 282, 380, 382 can be offset from their respective roller paths 233, 235, 333, 335 along the lateral direction L. An example is provided below.

As depicted in FIG. 14, first right protruding rib 282 projects upward from roller surface 240 of first right guide rail 234 along the vertical direction V. First right protruding rib 282 is offset laterally inward of roller path 235 in this example. That is, first right protruding rib 282 is positioned between second basket 310 and roller path 235 defined by first right guide rail 234 along the lateral direction L. First right protruding rib 282 has a ramped surface 284 and a curved surface 286 connected at an apex 288 of the first right protruding rib 282. Further, first right protruding rib 282 and a stop 246 of first right guide rail 234 define a pocket 248 in which a boss is receivable as will be explained further below. Although not shown in FIG. 14, first left protruding rib 280 can be similarly configured as first right protruding rib 282. Moreover, second left protruding rib 380 and second right protruding rib 382 can be similarly configured as first right protruding rib 282 except that the second protruding ribs 380, 382 include ramps at both their respective forward ends instead of a stop, e.g., as shown in FIGS. 13 and 14. Moreover, the second protruding ribs 380, 382 are positioned between the transverse midpoint of second basket 310 and back rollers 354, 356, respectively, along the transverse direction T.

As further shown in FIG. 14, front right roller 352 is connected to second basket 310 by a second right boss 388. Second right boss 388 extends or projects outward from right sidewall 330 along the lateral direction L. Front right roller 352 is connected to the distal end of second right boss 388. As noted above, front right roller 352 is operable to roll along roller path 235 of first right guide rail 234, e.g., along roller surface 240. Although not shown in FIG. 14, front left roller 350 is connected to second basket 310 by a second left boss 386 (FIG. 12). Second left boss 386 extends or projects outward from left sidewall 328 along the lateral direction L, e.g., in a direction opposite second right boss 388 along the lateral direction L. Front left roller 350 is connected to the distal end of second left boss 386. As noted above, front left roller 350 is operable to roll along roller path 233 of first left guide rail 232, e.g., along a roller surface thereof. Further, although not shown in FIG. 14, front left roller 450 can be connected to third basket 410 by a third left boss 486 (FIG. 12) in a similar manner as front right roller 352 is connected to second basket 310 by second right boss 388 and front left roller 452 can be connected to third basket 410 by a third right boss 488 (FIG. 13) in a similar manner as front right roller 352 is connected to second basket 310 by second right boss 388.

For this embodiment, when freezer door 130 (FIGS. 13 and 14) is moved forward together with first basket 210 along the transverse direction T, second left boss 386 of second basket 310 is operable to engage first left protruding rib 280 and second right boss 388 of second basket 310 is operable to engage first right protruding rib 282 such that second basket 310 is moved together with freezer door 130 and first basket 210 for a first predetermined distance when freezer door 130 is moved forward along the transverse direction T. Moreover, as freezer door 130 is moved further forward together with first basket 210 and second basket 310 along the transverse direction T, third left boss 486 of third basket 410 is operable to engage second left protruding rib 380 and third right boss 488 of third basket 410 is operable to engage second right protruding rib 382 such that third basket 410 is moved together with freezer door 130, first basket 210, and second basket 310 for a second predetermined distance when freezer door 130 is moved forward along the transverse direction T.

In some embodiments, when the baskets 210, 310, 410 are in their respective storage positions, second left boss 386 and second left boss 388 can be locked or engaged within the pockets of their respective first protruding ribs 280, 282. When freezer door 130 is moved forward along the transverse direction T, first basket 210 and second basket 310 are moved together with freezer door 120 along the transverse direction T for the first predetermined distance. When second basket 310 eventually disengages from first basket 210, the second left boss 386 and second right boss 388 of second basket 310 are slid upward along the vertical direction V along the curved surfaces of their respective first protruding ribs 280, 282 and then are gradually lowered downward along the vertical direction V along the ramped surfaces of their respective first protruding ribs 280, 282. The upward and downward movement of the bosses 386, 388, and consequently the tilting of third basket 410, provides a user with feedback that first basket 210 and second basket 310 have disengaged. Moreover, the ramped surface of the protruding ribs 280, 282 provide a smooth, gradual feel to the user.

Similarly, when freezer door 130 is moved further forward along the transverse direction T together with first basket 210 and second basket 310 along the transverse direction T, third left boss 486 and third right boss 488 of third basket 410 engage their respective second protruding ribs 380, 382, respectively, the bosses 486, 488 engage the forward ramped surfaces of their respective second protruding ribs 380, 382 such that the bosses 486, 488 are moved upward along the vertical direction V and then slide along the respective curved surfaces into their respective pockets after summiting at the apex. In this way, a user is provided feedback that third basket 410 and second basket 310 are engaged.

When third basket 410 eventually disengages from second basket 310, the third left boss 486 and third right boss 488 of third basket 410 are slid upward along the vertical direction V along the curved surfaces of their respective second protruding ribs 380, 382 and then are gradually lowered downward along the vertical direction V along the ramped surfaces of their respective second protruding ribs 380, 382. The upward and downward movement of the bosses 486, 488 provides a user with feedback that third basket 410 and second basket 310 have disengaged. Moreover, the ramped surface of the protruding ribs 380, 382 provide a smooth, gradual feel to the user.

Figure 15:
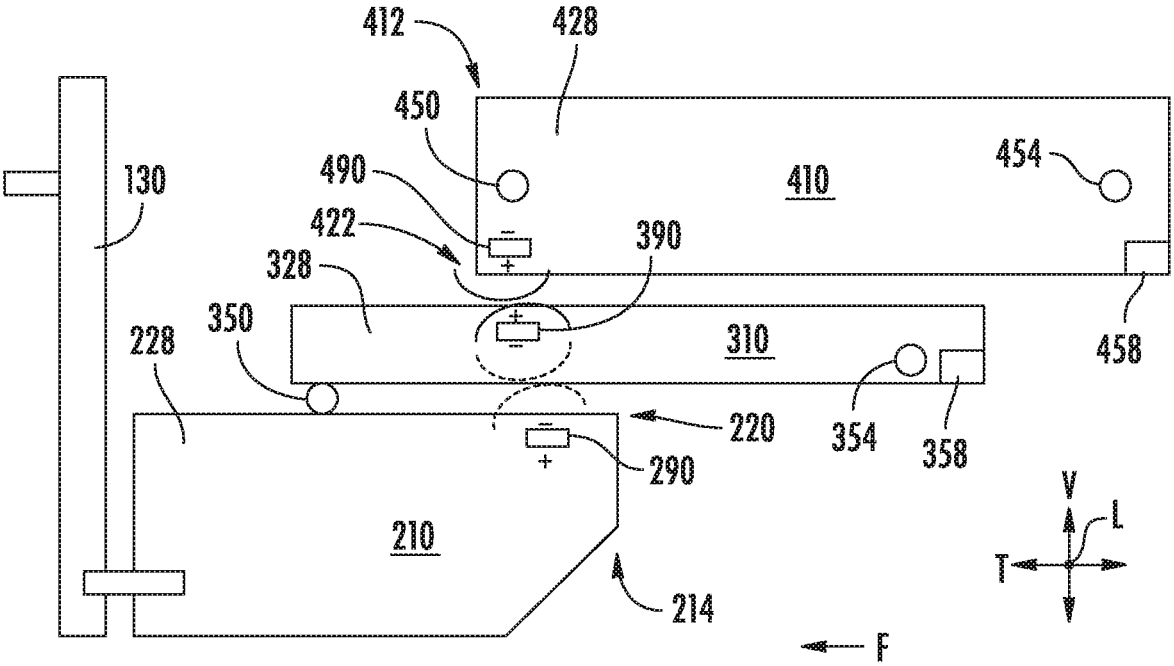
FIG. 15 provides a left side schematic view of yet another cascading basket system according to example embodiments of the present subject matter.
Figure 16:
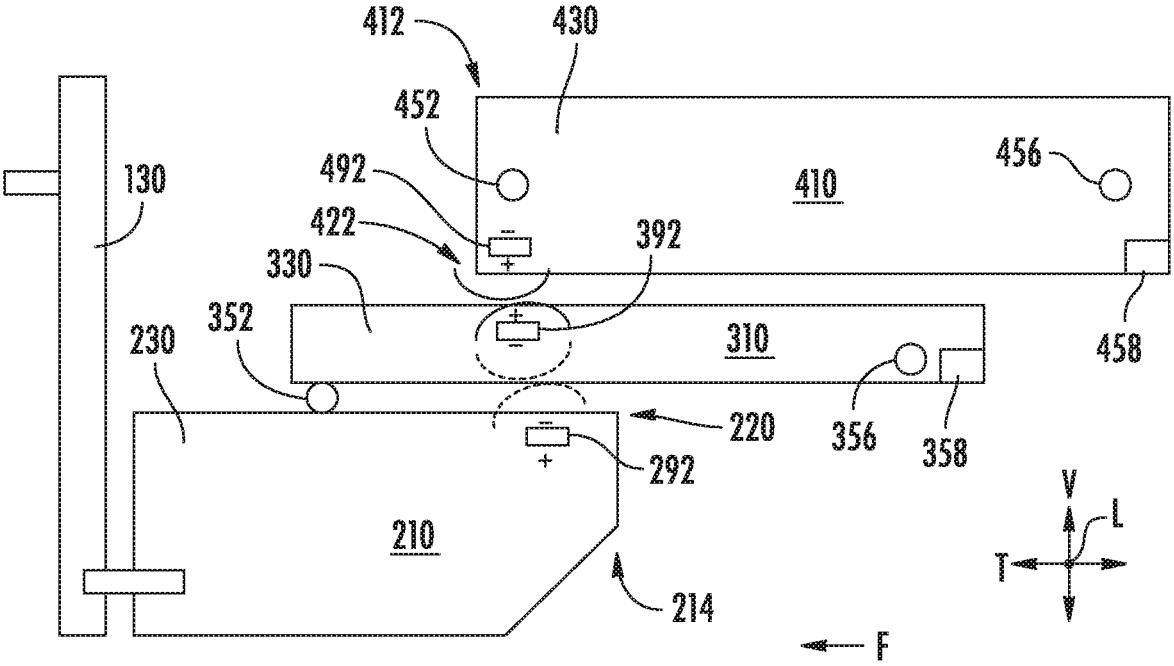
FIG. 16 provides a right side schematic view of the cascading basket system of FIG. 15.
Figure 17:
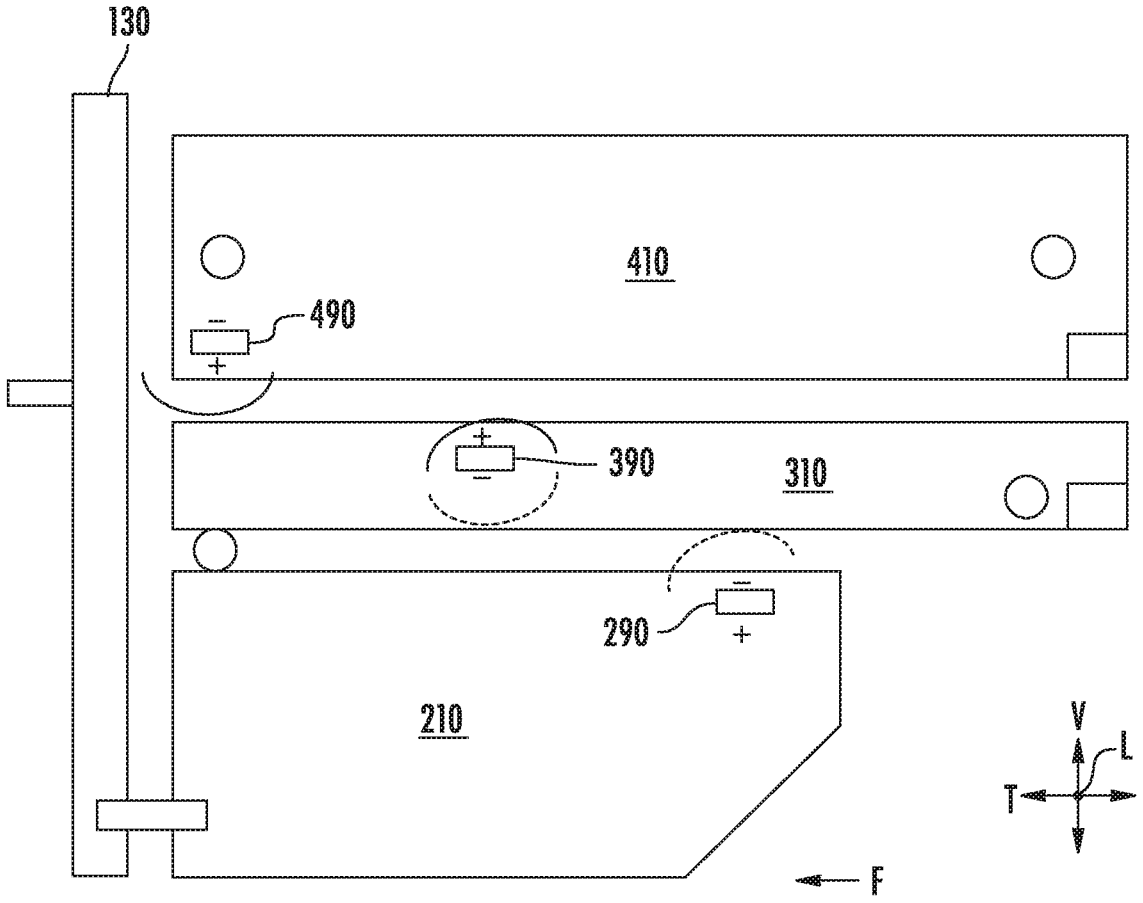
FIG. 17 provides a left side schematic view of the cascading basket system of FIG. 15 with the baskets thereof shown in a storage position.

FIGS. 15, 16, and 17 provide views of another embodiment of cascading basket system 200 according to example embodiments of the present subject matter. Particularly, FIG. 15 provides a left side schematic view of a cascading basket system according to example embodiments of the present subject matter and FIG. 16 provides a right side schematic view of the cascading basket system of FIG. 15. FIG. 17 provides a left side schematic view of the cascading basket system of FIG. 15 with the baskets thereof shown in a storage position. The cascading basket system 200 of FIGS. 15, 16, and 17 is configured in a similar manner as the cascading basket system of FIGS. 3 through 9 except as provided below.

As shown in FIGS. 15 and 16, for this embodiment, first basket 210 has a first left magnet 290 (FIG. 15) and a first right magnet 292 (FIG. 16). First left magnet 290 can be attached to or embedded within left sidewall 228 of first basket 210 and first right magnet 292 can be attached to or embedded within right sidewall 230 of first basket 210. First left and right magnets 290, 292 are positioned at or adjacent the top 220 of first basket 210 and at or adjacent back 214 of first basket 210. In addition, second basket 310 has a second left magnet 390 (FIG. 15) and a second right magnet 392 (FIG. 16). Second left magnet 390 can be attached to or embedded within left sidewall 328 of second basket 310 and second right magnet 392 can be attached to or embedded within right sidewall 330 of second basket 310. Further, third basket 410 has a third left magnet 490 (FIG. 15) and a third right magnet 492 (FIG. 16). Third left magnet 490 can be attached to or embedded within left sidewall 428 of third basket 410 and third right magnet 492 can be attached to or embedded within right sidewall 430 of third basket 410. Third left and right magnets 490, 492 are positioned at or adjacent the bottom 422 of third basket 410 and at or adjacent front 412 of third basket 410.

Notably, first left magnet 290 and second left magnet 390 are oriented such that first left magnet 290 and second left magnet 390 are arranged in opposing polarity. Similarly, first right magnet 292 and second right magnet 392 are oriented such that first right magnet 292 and second right magnet 392 are arranged in opposing polarity. For instance, as shown best in FIG. 15, first left magnet 290 and second left magnet 390 are arranged so that the negative poles (denoted by the negative sign "–" in FIG. 15) of the magnets oppose one another. As shown best in FIG. 16, first right magnet 292 and second right magnet 392 are arranged so that the negative poles (denoted by the negative sign "–" in FIG. 16) of the magnets oppose one another.

In a similar manner, second left magnet 390 and third left magnet 490 are oriented such that second left magnet 390 and third left magnet 490 are arranged in opposing polarity. Similarly, second right magnet 392 and third right magnet 492 are oriented such that second right magnet 492 and third right magnet 492 are arranged in opposing polarity. For instance, as shown best in FIG. 15, second left magnet 390 and third left magnet 490 are arranged so that the positive poles (denoted by the positive sign "+" in FIG. 15) of the magnets oppose one another. As shown best in FIG. 16, second right magnet 392 and third right magnet 492 are arranged so that the positive poles (denoted by the positive sign "+" in FIG. 16) of the magnets oppose one another. Further, as shown in FIG. 17, when first basket 210, second basket 310, and third basket 410 are positioned in the storage position within freezer chamber 124 (FIG. 2), third magnet 490 is positioned forward of second magnet 390 and second magnet 390 is positioned forward of first magnet 290 along the transverse direction T.

Accordingly, with reference to FIGS. 15 and 16, when freezer door 130 and first basket 210 are moved forward together along the transverse direction T, the first magnets 290, 292 come into proximity of second magnets 390, 392, the opposing polarity of the magnets 290, 390 and 292, 392 propels or pushes second basket 210 forward together with freezer door 130 and first basket 210 along the transverse direction T. As a result, freezer door 130, first basket 210, and second basket 310 are moved forward along the transverse direction T together, e.g., for a predetermined distance.

As freezer door 130, first basket 210, and second basket 310 are moved forward along the transverse direction T, the second magnets 390, 392 eventually come into proximity of third magnets 490, 492. When this occurs, the opposing polarity of the magnets 390, 490 and 392, 492 propels or pushes third basket 410 forward together with freezer door 130, first basket 210, and second basket 310. Consequently, freezer door 130, first basket 210, second basket 310, and third basket 410 are moved forward along the transverse direction T together, e.g., for a predetermined distance. Accordingly, all of the baskets 210, 310, 410 can be moved forward together as a single unit along the transverse direction T. Stops 358 of second basket 310 and stops 458 of third basket 410 can limit the forward transverse travel of their respective baskets. Furthermore, advantageously, when freezer door 130 is pushed backward (i.e., a direction opposite the forward direction along the transverse direction T), the magnets can be used to propel or push the baskets 310, 410 back into their storage positions (FIG. 17), thus reducing the force required by the user to push freezer door 130 to the closed position.

In some alternative embodiments, only a single side of cascading basket system 200 need include magnets. For instance, in some embodiments, first basket 210 can include a first magnet attached to or embedded within left sidewall 228 of first basket 210, second basket 310 can include a second magnet attached to or embedded within left sidewall 328 of second basket 310, and third basket 410 can include a third magnet attached to or embedded within right sidewall 428 of third basket 410. In such embodiments, the right sidewalls of the respective baskets need not include magnets attached to or embedded therein. In yet other embodiments, all of the magnets can be attached to or embedded within the respective right sidewalls of the baskets 210, 310, 410 and the left sidewalls need not include magnets attached to embedded therein.

Further, the cascading basket systems 200 described and illustrated herein disclose embodiments including three (3) baskets. However, one of skill in the art will appreciate that the inventive aspects disclosed herein can apply to cascading basket systems having more or less than three (3) baskets. Moreover, it will be appreciated that the inventive aspects disclosed herein can be applied only to a single side of the baskets of the cascading basket system. For instance, in some embodiments, a basket can define a pocket recess on only one side of the basket. Further, in some embodiments, a basket can include a protruding rib on only one side of the basket. Moreover, in some embodiments as noted above, the basket can include a magnet on only one side of the basket.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a housing defining a chamber;

a door movable forward and backward for providing selective access to the chamber;

a cascading basket system, comprising:

a first basket connected to the door and operable to travel forward and backward together with the door, wherein the first basket has a first guide rail that defines a first pocket recess and has a protruding rib offset from a first roller path;

a second basket operable to travel forward and backward and having a second guide rail that defines a second pocket recess, wherein the second basket has a roller connected to the second basket by a boss and operable to roll along the first guide rail of the first basket and is receivable within the first pocket recess such that the second basket is moved together with the door and the first basket for a first predetermined distance when the door is moved forward; and a third basket operable to travel forward and backward and having a roller operable to roll along the second guide rail of the second basket and is receivable within the second pocket recess such that the third basket is moved together with the door, the first basket, and the second basket for a second predetermined distance when the door is moved forward.

2. The appliance of claim 1, wherein the appliance defines a vertical direction, and wherein the first basket is a bottom basket, the second basket is a middle basket positioned above the bottom basket along the vertical direction, and the third basket is a top basket positioned above the middle basket along the vertical direction.

3. The appliance of claim 1, wherein the appliance defines a transverse direction and the door, the first basket, the second basket, and the third basket are movable forward and backward along the transverse direction, and wherein the second basket has a liner roller positioned backward of the roller of the second basket along the transverse direction, the liner roller operable to roll along a liner guide rail connected to or integrally formed with a liner of the housing, and wherein the second pocket recess is defined by the second guide rail between the roller of the second basket and the liner roller along the transverse direction.

4. The appliance of claim 1, wherein the third basket is operatively coupled with the housing via a slide assembly.

5. The appliance of claim 4, wherein the roller of the third basket is a spring-loaded roller that is biased in contact with the second guide rail of the second basket.

6. The appliance of claim 5, wherein the spring-loaded roller is lockable in a disengaged position such that the spring-loaded roller is not receivable in the second pocket recess.

7. The appliance of claim 1, wherein the third basket is operatively coupled with the housing via one or more rollers.

8. The appliance of claim 1, wherein the appliance defines a lateral direction and a transverse direction, and wherein the first basket, the second basket, and the third basket each extend between a left side and a right side along the lateral direction, the door, the first basket, the second basket, and the third basket are each operable to travel forward and backward along the transverse direction, and wherein the first guide rail of the first basket is a left guide rail and the first pocket recess is a first left pocket recess, and wherein the left guide rail extends longitudinally along the transverse direction at the left side of the first basket and wherein the first basket has a right guide rail that extends longitudinally along the transverse direction at the right side of the first basket, the right guide rail defining a first right pocket recess, and wherein the roller of the second basket is a left side roller operable to roll along the left guide rail and wherein the second basket has a right side roller operable to roll along the right guide rail and is receivable within the first right pocket recess.

9. The appliance of claim 1, wherein the first basket is movable to a first withdrawn position in which the first basket is fully withdrawn from the chamber, the second basket is movable to a second withdrawn position in which the second basket is fully withdrawn from the chamber, and the third basket is movable to a third withdrawn position in which the third basket is fully withdrawn from the chamber, wherein when each of the first, second, and third baskets are in their respective first, second, and third withdrawn positions, the first basket is positioned forward of the second basket and the second basket is positioned forward of the third basket.

10. The appliance of claim 1, wherein the first basket has a first pocket recess cover movable between a cover position in which the first pocket recess cover is covers the first pocket recess such that the roller of the second basket is not receivable within the first pocket recess and a non-cover position in which the first pocket recess cover does not cover the first pocket recess such that the roller of the second basket is receivable within the first pocket recess.

11. The appliance of claim 1, wherein the appliance defines a transverse direction and the door, the first basket, the second basket, and the third basket are movable forward and backward along the transverse direction, and wherein the first pocket recess defined by the first guide rail has a transverse length that is less than a diameter of the roller of the second basket, and wherein the second pocket recess defined by the second guide rail has a transverse length that is less than a diameter of the roller of the third basket.

12. The appliance of claim 1, wherein the appliance is a refrigerator appliance and wherein the chamber is a freezer chamber.

13. An appliance, comprising:

a housing defining a chamber;

a door movable forward and backward for providing selective access to the chamber;

a cascading basket system, comprising:

a first basket connected to the door and operable to travel forward and backward together with the door, wherein the first basket has a first guide rail that defines a first roller path and has a protruding rib offset from the first roller path;

a second basket operable to travel forward and backward, wherein the second basket has a roller connected to the second basket by a boss, the roller of the second basket operable to roll along the first roller path of the first guide rail and the boss of the second basket is operable to engage a first protruding rib such that the second basket is moved together with the door and the first basket for a first predetermined distance when the door is moved forward.

14. The appliance of claim 13, wherein the second basket has a second guide rail that defines a second roller path and has a second protruding rib offset from the second roller path.

15. The appliance of claim 14, wherein the cascading basket system further comprises:

a third basket operable to travel forward and backward, wherein the third basket has a roller connected to the third basket by a third boss, the roller of the third basket operable to roll along the second roller path of the second guide rail and wherein the boss of the second basket is operable to engage the second protruding rib such that the third basket is moved together with the door, the first basket, and the second basket for a second predetermined distance when the door is moved forward.

16. The appliance of claim 13, wherein the appliance defines a vertical direction, and wherein the protruding rib projects upward from a roller surface of the first guide rail along the vertical direction, the protruding rib and a stop of the first guide rail defining a pocket in which the boss is receivable.

17. The appliance of claim 16, wherein the first protruding rib has a ramped surface and a curved surface connected at an apex of the first protruding rib, and wherein when the boss of the second basket engages the first protruding rib, the boss engages the ramped surface such that the boss is moved upward along the vertical direction and then slides into the pocket along the curved surface after summiting at the apex.

18. An appliance, comprising:

a housing defining a chamber;

a door movable forward and backward for providing selective access to the chamber;

a cascading basket system, comprising:

a first basket connected to the door and operable to travel forward and backward together with the door, wherein the first basket has a first magnet and a first guide rail that defines a first roller path and has a protruding rib offset from the first roller path;

a second basket operable to travel forward and backward, wherein the second basket has a roller connected to the second basket by a boss and operable to roll along the first roller path of the first guide rail, and wherein the second basket also has a second magnet oriented such that the first magnet and the second magnet are arranged in opposing polarity so that the second basket is moved forward when the door is moved forward.

19. The appliance of claim 18, wherein the second basket has a second guide rail that defines a second roller path, and wherein the cascading basket system further comprises:

a third basket operable to travel forward and backward, wherein the third basket has a roller operable to roll along the second roller path of the second guide rail, and wherein the third basket also has a third magnet oriented such that the second magnet and the third magnet are arranged in opposing polarity so that the third basket is moved forward when the door is moved forward.

20. The appliance of claim 19, wherein the third magnet is positioned forward of the second magnet and the second magnet is positioned forward of the first magnet when the first basket, second basket, and third basket are positioned in a storage position within the chamber.

* * * * *